US012566051B2

(12) United States Patent
Knezek et al.

(10) Patent No.: US 12,566,051 B2
(45) Date of Patent: Mar. 3, 2026

(54) FLOATING BARRIER SYSTEM

(71) Applicant: Oceanetics, Inc., Annapolis, MD (US)

(72) Inventors: Erick Knezek, Lafayette, LA (US); Matthew Marcy, Bluemont, VA (US); David Delleart, Washington, MO (US); Mark Wood, Tarpon Springs, FL (US); William Newton Seelig, Rockville, MD (US); Eric Jacobs, St. Louis, MO (US)

(73) Assignee: OCEANETICS, INC., Annapolis, MD (US)

( * ) Notice: Subject to any disclaimer, the term of this patent is extended or adjusted under 35 U.S.C. 154(b) by 69 days.

(21) Appl. No.: 17/796,665

(22) PCT Filed: Mar. 2, 2022

(86) PCT No.: PCT/US2022/018417
§ 371 (c)(1),
(2) Date: Jul. 31, 2022

(87) PCT Pub. No.: WO2022/187294
PCT Pub. Date: Sep. 9, 2022

(65) Prior Publication Data

US 2024/0183641 A1 Jun. 6, 2024

Related U.S. Application Data

(60) Provisional application No. 63/155,659, filed on Mar. 2, 2021.

(51) Int. Cl.

| | |
|---|---|
| ***F41H 11/05*** | (2006.01) |
| ***B63G 9/04*** | (2006.01) |
| ***E02B 3/20*** | (2006.01) |

(52) U.S. Cl.
CPC ..... *F41H 11/05* (2013.01); *B63G 9/04* (2013.01); *E02B 3/20* (2013.01)

(58) Field of Classification Search
CPC ..... F41H 11/00; F41H 11/05; B63G 9/00; B63G 9/04; E02B 3/00; E02B 3/04; E02B 3/20; E02B 15/0807
USPC ..... 114/241
See application file for complete search history.

(56) References Cited

U.S. PATENT DOCUMENTS

| | | | | |
|---|---|---|---|---|
| 6,681,709 | B1 * | 1/2004 | Nixon | F41H 11/05 114/241 |
| 7,401,565 | B2 * | 7/2008 | Nixon | F41H 11/05 114/241 |
| 10,378,862 | B2 * | 8/2019 | Terai | F41H 11/05 |

* cited by examiner

*Primary Examiner* — Lars A Olson
(74) *Attorney, Agent, or Firm* — LAW OFFICE OF JESSE D. LAMBERT, LLC

(57) ABSTRACT

A floating barrier system has a plurality of connected floating barrier units. Capture net segments are positioned on the floating barrier units by support post members, forming a barrier to vessel passage. Lanyards attach the ends of the capture net segments to the floating barrier units. Upon a vessel striking the capture net segments with sufficient force, the capture nets detach from the support post members and/or pull the support post members over, and the forces from the vessel are transferred via the lanyards to the floating barrier unit. The vessel is prevented from fully passing over the floating barrier unit, thus itself forming a barrier to passage by other vessels.

25 Claims, 10 Drawing Sheets

FLOATING BARRIER SYSTEM

CROSS REFERENCE TO RELATED APPLICATIONS

This United States non-provisional patent application claims priority to U.S. provisional patent application Ser. No. 63/155,659, filed Mar. 2, 2021, for all purposes. The disclosure of that provisional patent application is incorporated herein by reference, to the extent not inconsistent with this disclosure.

BACKGROUND—FIELD OF THE INVENTION

Various floating barrier systems exist to control passage of floating vessels, whether to a defined area, or along a river or the like. In addition, floating barrier systems can control passage of underwater vessels or personnel.

SUMMARY OF THE INVENTION

The floating barrier system disclosed herein comprises, generally, one or more than one connected together floating barrier units, installed in a desired location to control waterborne (above or below the water's surface) passage.

In a preferred embodiment, each of the floating barrier units comprises a generally horizontal spar member, supported above a waterbody surface generally perpendicularly attached buoyant members which buoyantly support each floating barrier unit atop the waterbody. The floating barrier units are connected by flexible connector members, for example solid urethane connector members. Each of the floating barrier units has a plurality of upwardly extending capture net segment support post members; for example, each unit may have six net segment support post members, plus a seventh post which serves as (in essence) an intermediate net alignment post. The support post members support and hold in place capture net segments. Preferably, the capture net segments on each floating barrier unit do not span the entirety of the length of the spar member; instead, as later described herein, each net is only a fraction of the length of the horizontal spar member, for example roughly ⅓ of the total length. These shorter net segments are attached to the upwardly extending capture net segment support post members. In addition, in a preferred embodiment, a net segment support element, which may be a cable or similar element, spans the distance between the support post members, with the net segment suspended from the support element. Lanyards attach the capture net segments to the horizontal spar; the lanyards ultimately transfer forces imposed on the capture net segments by a vessel striking same, to the horizontal spar.

DESCRIPTION OF THE PRESENTLY PREFERRED EMBODIMENT(S)

While various floating barrier systems can embody the principles of the present invention, with reference to the drawings some of the presently preferred embodiments can be described.

Figure 1:
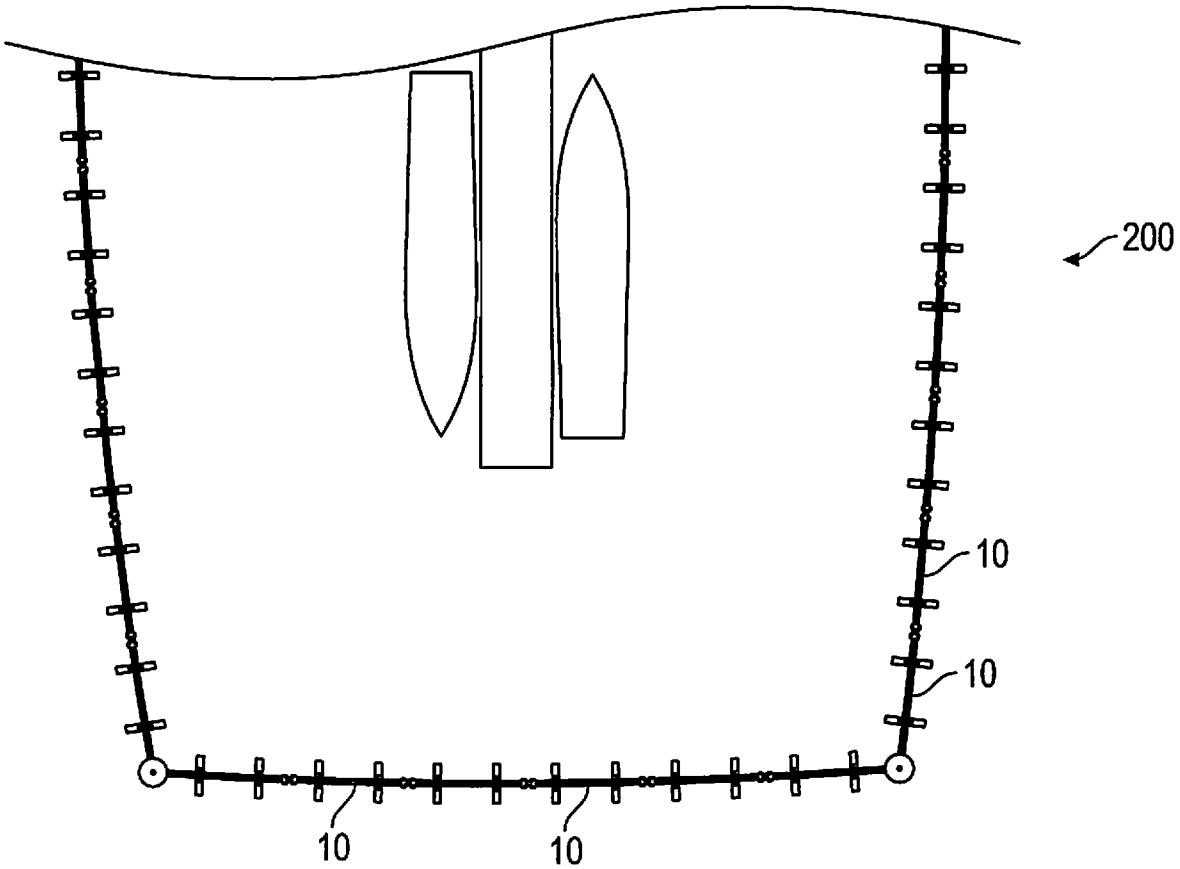
FIG. 1 is a top view generally showing a number of floating barrier units in place in a waterbody, forming a floating barrier system.
Figure 2:
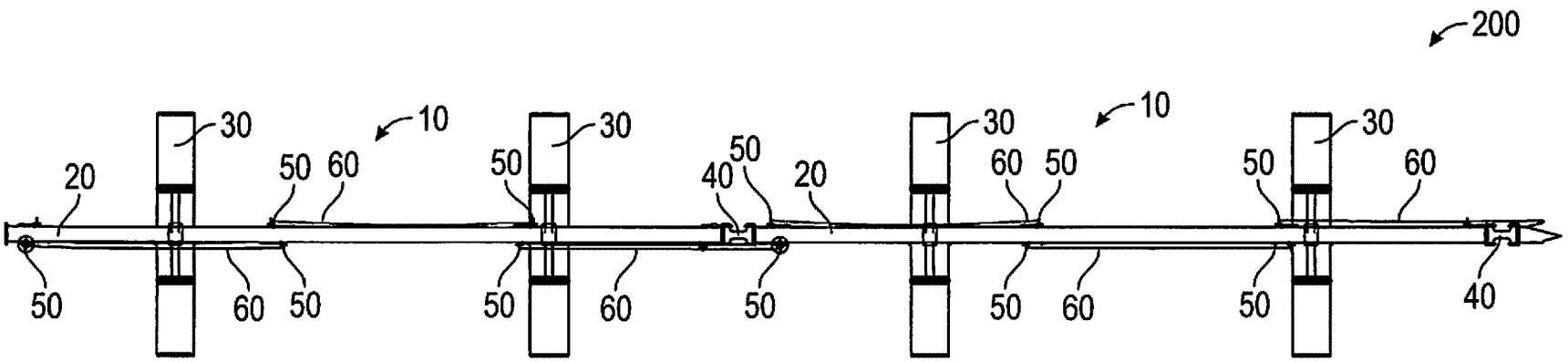
FIG. 2 is a top view of a system of connected floating barrier units.
Figure 3:
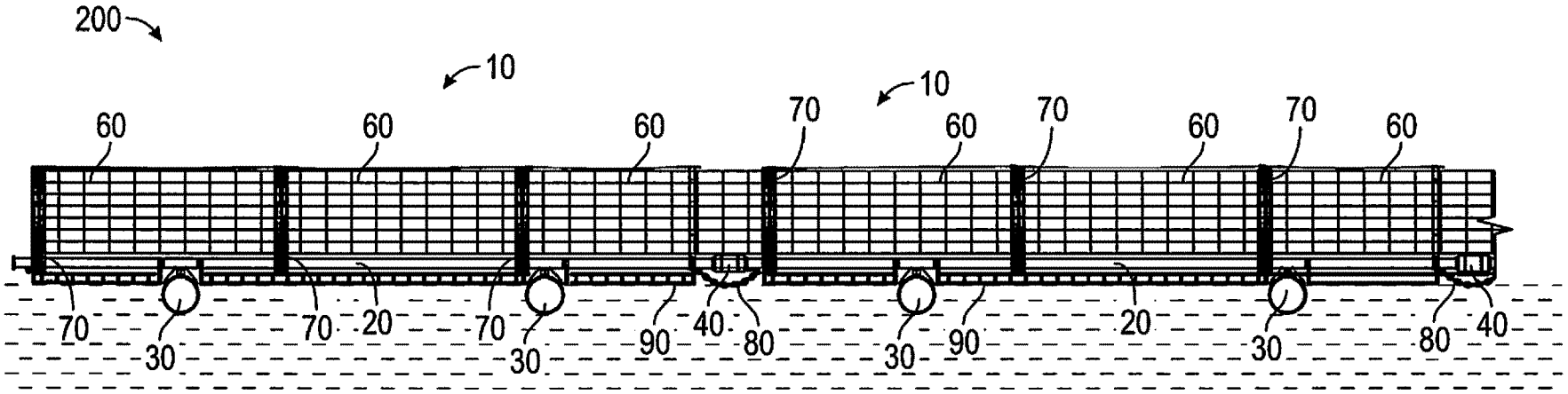
FIG. 3 is a front view of the connected floating barrier units of FIG. 2, from the perspective of a vessel approaching the barrier; this may be referred to as the "threat" side.

FIG. 1 is a view of a number of floating barrier units 10 in place on a waterbody, illustrating an installation of same and forming a floating barrier system 200. It is understood that floating barrier units 10 (only some of which are annotated) may be placed so as to protect a defined, protected area, such as a port or harbor; or alternatively may serve to control passage of vessels down a waterway.

FIGS. 2-5 show top (FIGS. 2 and 4) and front (FIGS. 3 and 5) views of an embodiment of several connected floating barrier units 10 forming a part of a floating barrier system 200. Each of the floating barrier units 10 comprises a generally horizontally disposed spar member 20, having a desired length, and supported by one or more buoyant members, for example as shown a pair of generally perpendicularly attached buoyant members 30. A representative water surface is shown in the figures; typically, spar member 20 is supported above the water surface a desired distance. It is understood that a greater or lesser number of buoyant members 30 may be used; the number and placement of buoyant members 30 may be varied to suit particular installations. Floating barrier units 10 are connected by flexible connector members 40, which in a preferred embodiment comprise solid urethane connectors. Solid urethane connectors avoid corrosion and degradation issues present with chain or metal cable connectors or the like. In addition, flexible connector members 40 made of solid urethane can support or transmit both compression and tension loads, thereby assisting in keeping floating barrier units 10 at a desired spacing (i.e. adjacent units cannot move side-to-side toward one another). Other materials with properties similar to urethane may be used for connectors 40.

Figure 12:
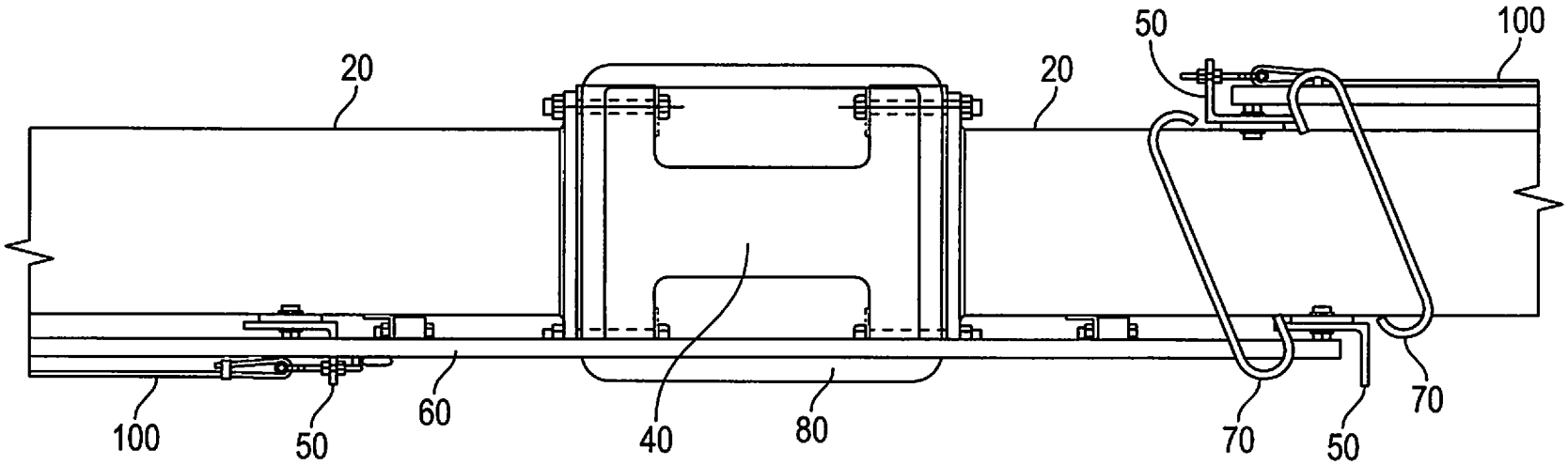
FIG. 12 is a top view of a section of a floating barrier unit, showing more detail regarding the connecting member and lanyards.

In addition, in a preferred embodiment, a secondary flexible connector member 80 may be used for additional connection between floating barrier units 100. Secondary flexible connector member 80 may comprise cable, chain, or some other form of non-corrosive material; an additional embodiment is shown in FIG. 12 and described further herein.

Figure 4:
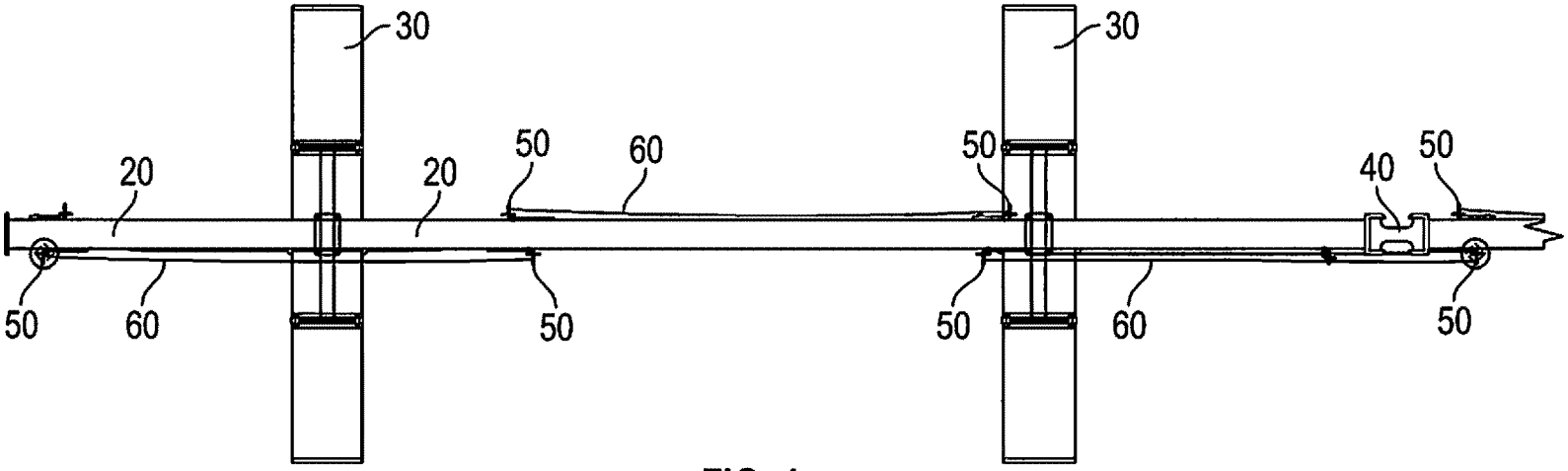
FIGS. 4 and 5 show more detail of the floating barrier units of FIGS. 2 and 3, respectively.
Figure 5:
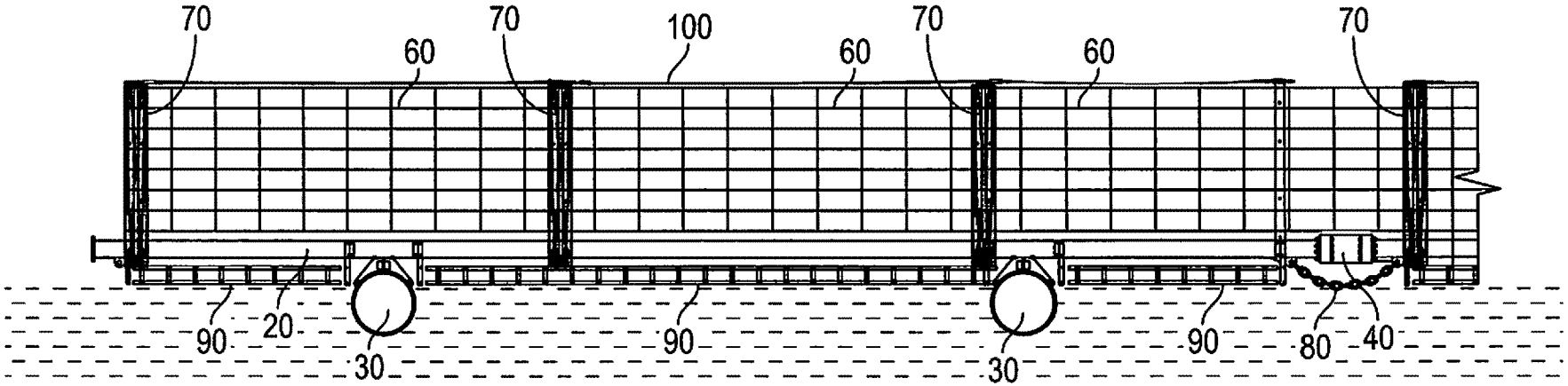

Each of the floating barrier units 10 has a plurality of upwardly extending support post members 50, supporting capture net segments 60. In the attached drawing, each floating barrier unit 10 has six support post members 50, plus a seventh support post member 50 which serves as (in essence) an intermediate net alignment post. It is important to note that, in a preferred embodiment, the capture net segments 60 on each floating barrier unit 10 have a length less than the length of spar member 20, and consequently do not span the entirety of the length of spar member 20; instead, as can be seen, each capture net segment 60 is only a fraction of the length of spar member 20, for example roughly ⅓ of the length of spar member 20. FIG. 4 better shows the length of capture net segments 60 relative to the length of spar member 20. It is understood that the scope of the invention is not confined to any particular net length. These shorter capture net segments 60 are attached to the upwardly extending support post members 50, generally one support post member 50 proximal each end of each capture net segment 60. Preferably, capture net segments 60 are attached to each of support post members 50.

Figure 13:
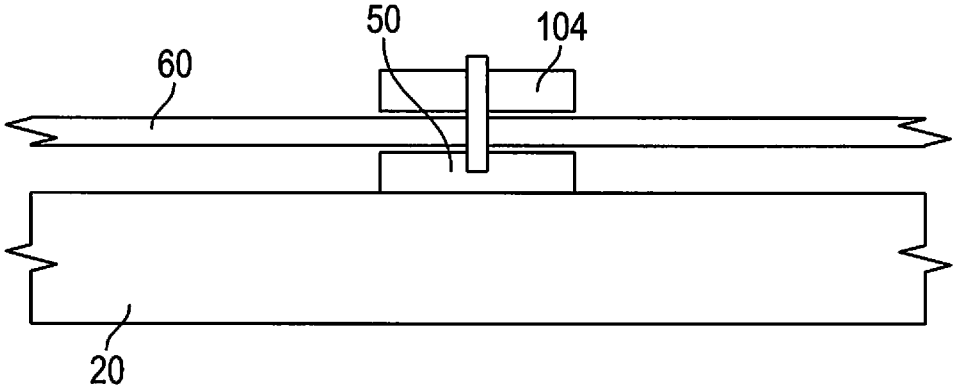
FIG. 13 is a detailed view of an attachment of a net segment to a support post member.

In a preferred embodiment, net segments 60 are attached to support post members 50 by an arrangement having, by design, only a limited attachment force; namely, when a given force is applied to a net segment 60, it will by design pull away from or out of attachment with support post member 50. FIG. 13 shows one possible embodiment of such attachment, with a plate member 104 attaching to support post member 50, with net segment 60 held therebetween.

In addition, support post members 50 may be mounted to spar 20 in a manner to intentionally fail under a given force, namely to bend over in the direction of a vessel strike location.

It is understood that a vessel attempting to cross a floating barrier unit 10 (or assembly of same in a floating barrier system 200) would likely ride up over floating barrier unit 10 and into one or more of capture net segments 60, to be caught therein. Lanyards 70 attach capture nets 60 to spar member 20; lanyards 70 ultimately transfer loads imposed on the capture net segments 60 by a vessel striking same, to spar member 20.

As can be more easily seen in FIG. 4, in a preferred embodiment one of capture net segments 60 extends beyond the end of spar member 20, across the gap and across flexible connector member 40 between adjacent floating barrier units 10, and connects to a support post member 50 on an adjacent floating barrier unit 10. It is understood that in this manner adjacent floating barrier units 10 are connected by capture net segments 60, in addition to connection via flexible connector members 40. Effectively, continuous capture net segment 60 coverage for the entirety of the length of a floating barrier system 200 installation is achieved by capture net segments 60 spanning the spaces between floating barrier units 10. However, due to the relatively shorter length of capture net segments 60, a vessel strike on one capture net segment 60 does not pull on or otherwise disrupt other capture net segments 60, keeping the barrier intact.

Capture net segments 60 may take various forms. Preferably, capture nets 60 have a mesh with a horizontal dimension of approximately 20" and a vertical dimension of approximately 9½", along with horizontal net ropes of approximately 1½" diameter. Capture net segments 60 may be made of nylon rope or similar synthetic fiber. However, it is to be understood that capture nets 60 may have a mesh size of any desired dimensions, and any number of materials may be used for the nets.

If desired, a barrier element 90 may be attached to spar member 20, extending downwardly toward or below the water surface. This element would tend to minimize vessels going under floating barrier units 10, and to some degree hinder other threats such as personnel (for example, divers) from swimming beneath the units.

FIGS. 6-9 show yet additional detail of certain elements of floating barrier units 10. Capture net segment 60 is omitted from a part of floating barrier section 10 to better show other elements. A net segment support element 100 may run between support post members 50, to assist in keeping capture net segments 50 in proper position. Lanyards 70 are shown in these figures and described in more detail below. As previously described, it is understood that a key aspect of floating barrier units 10 is the transfer of force (from the kinetic energy in a moving vessel) from a vessel striking the barrier units, first to capture net segments 60, then to lanyards 70, then to spar member 20. While some force will be transferred to support post members 50, the primary force transfer is to spar members 20. In some embodiments, as noted above, capture net segments 60 may be mounted to support posts 50 by relatively weak attachments, effectively providing a "break away" arrangement, such that forces are almost completely transferred from capture net segments 60 to the spar members 20, via lanyards 70. In addition, net segment support element 100 may be designed to fail under a given force, further assisting in the force transfer to lanyards 70. This force transfer arrangement (namely, transferring the forces from a moving vessel to spar member 20, via lanyard 70, at a very low or nearly horizontal direction) minimizes rotation of the floating barrier unit 10 around the longitudinal axis of the unit (namely, of spar member 20), due to a vessel strike. This attribute keeps the remaining portion of the overall floating barrier system 200 in an operative mode.

Figure 6:
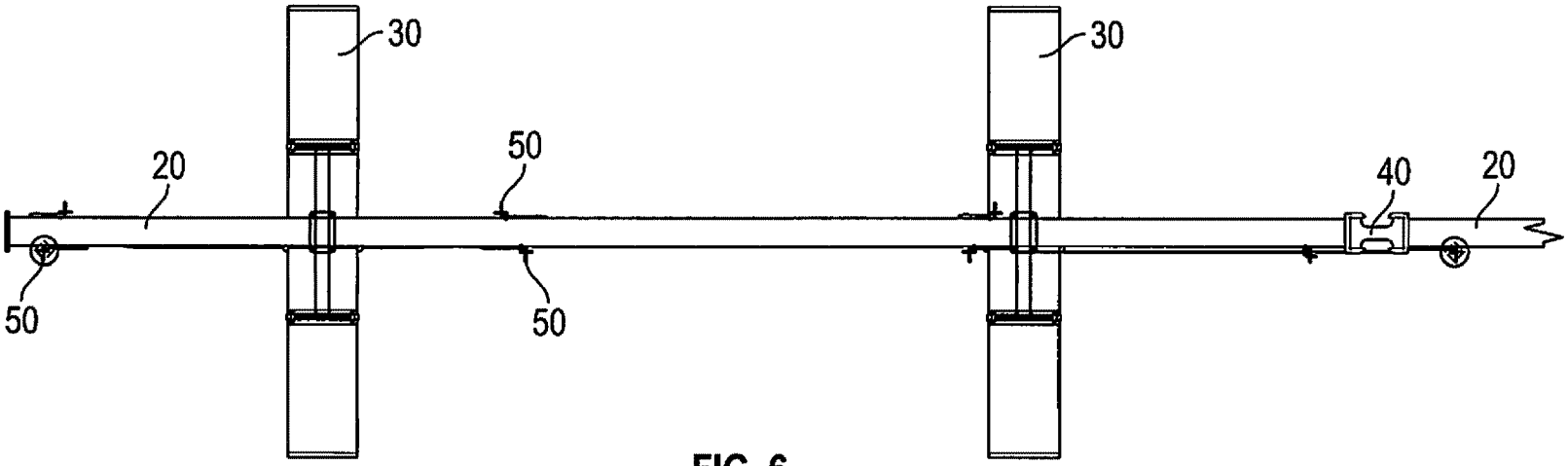
FIG. 6 is a top view in more detail of two connected floating barrier units, with certain elements omitted for clarity.
Figure 7:
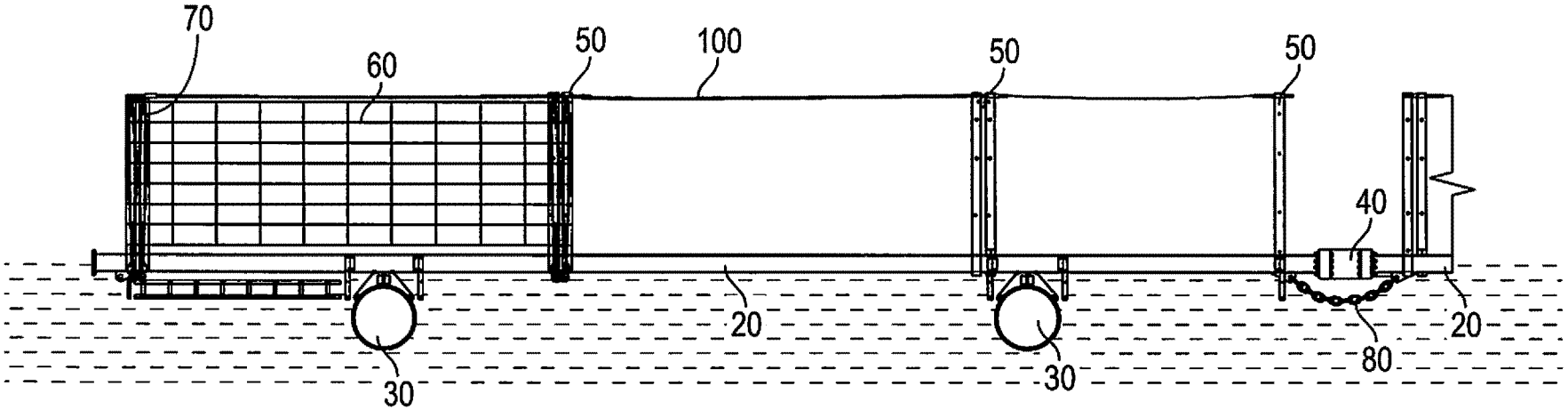
FIG. 7 is a front view of the connected floating barrier units of FIG. 6.
Figure 8:
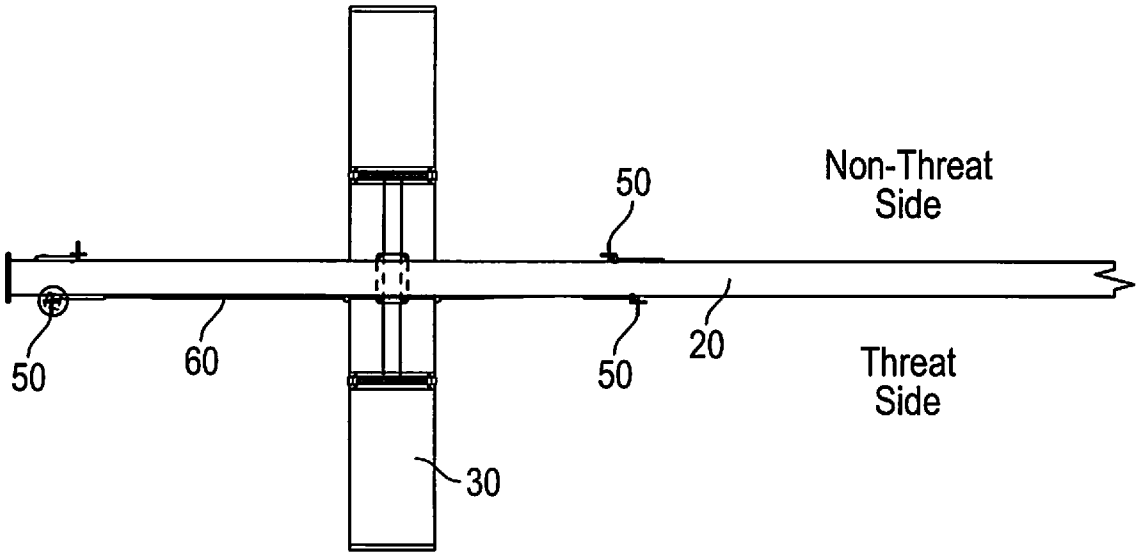
FIGS. 8 and 9 are still more detailed views of the floating barrier units of FIGS. 6 and 7.
Figure 9:
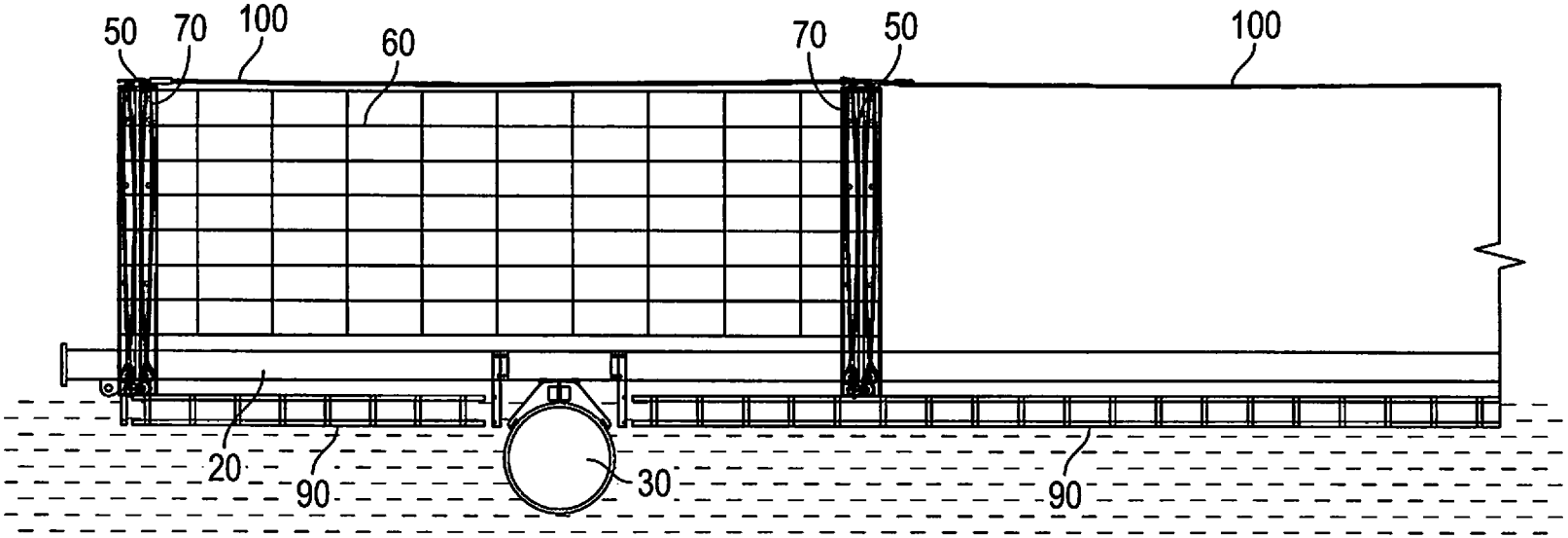

In FIGS. 8 and 9, in particular FIG. 8, a notation of "threat side" and "non-threat side" can be seen. The threat side is the direction from which approaching vessels would be expected, namely the side from which a vessel strike would be expected. The non-threat side is the opposite side. As can be seen in FIGS. 6 and 8, in a preferred embodiment, post support members 50 are mounted in such that a pair of post support members 50 are mounted on one side (e.g. the threat side) of spar member 20, then along the length of spar member 20 the next pair of post support members 50 are mounted on the opposite side (e.g. the non-threat side). This permits placement of net segments 60 on alternating sides of spar member 20, and assists in preserving net segment coverage over the entirety of the length of spar member 20, while preventing a given net segment 60 from pulling down an adjacent net segment 60 in the event of a vessel strike.

Figure 10:
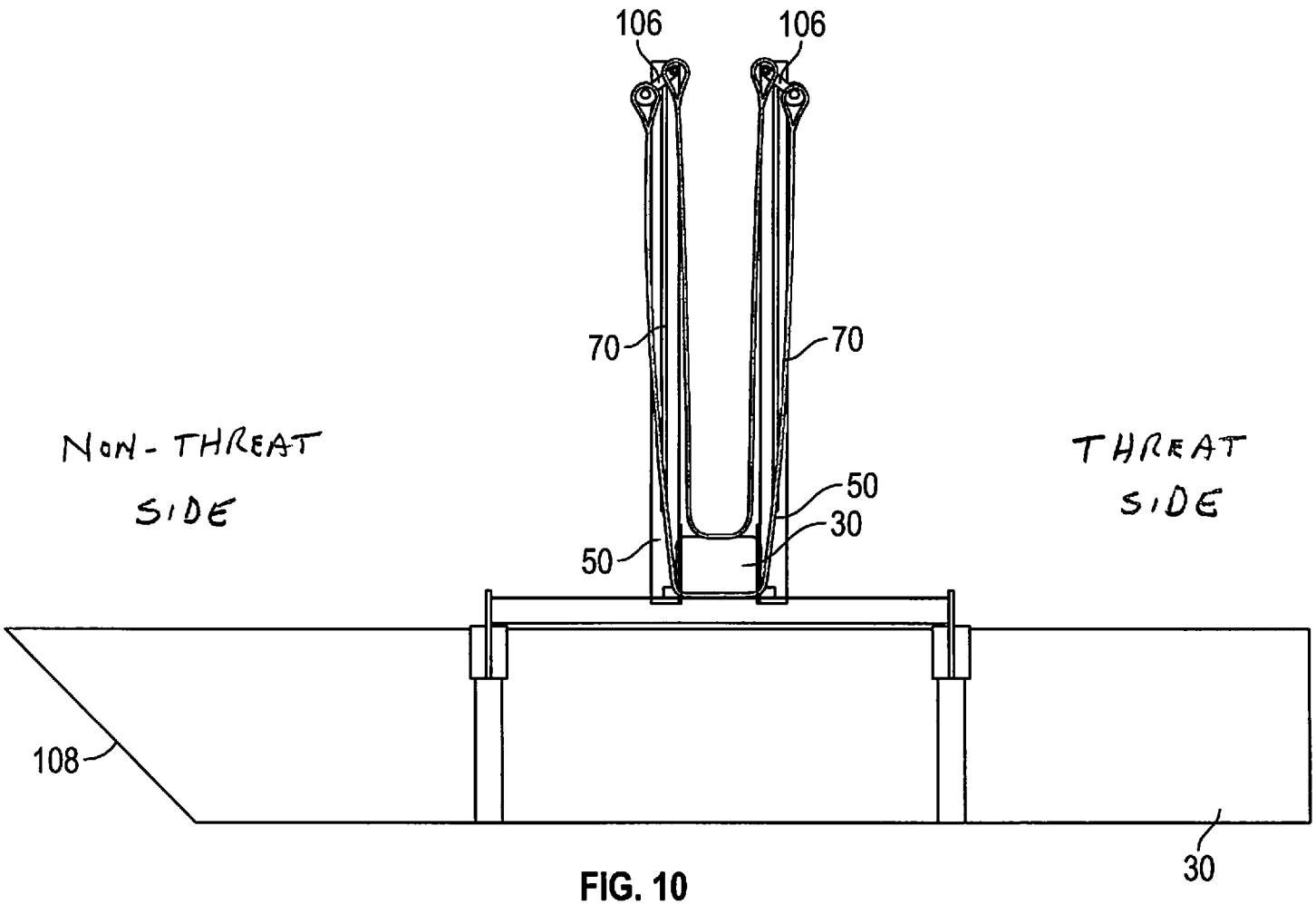
FIG. 10 is a detailed, cross section view of a floating barrier unit, showing more detail regarding the lanyards, spar member, and buoyant member.

FIG. 10 is a cross section view of a floating barrier unit 10, showing in particular spar member 20, buoyant member 30, support post members 50, and lanyards 70. It can be seen that in this embodiment, lanyards 70 run through net segments 60, and attach to spar 20 by passing around (encircling) spar member 20, then attaching to itself to form an endless loop. Such attachment (of the two ends of a lanyard 70) may be by shackles (as shown in FIG. 10), splicing, or any other means known in the relevant art.

Figure 14:
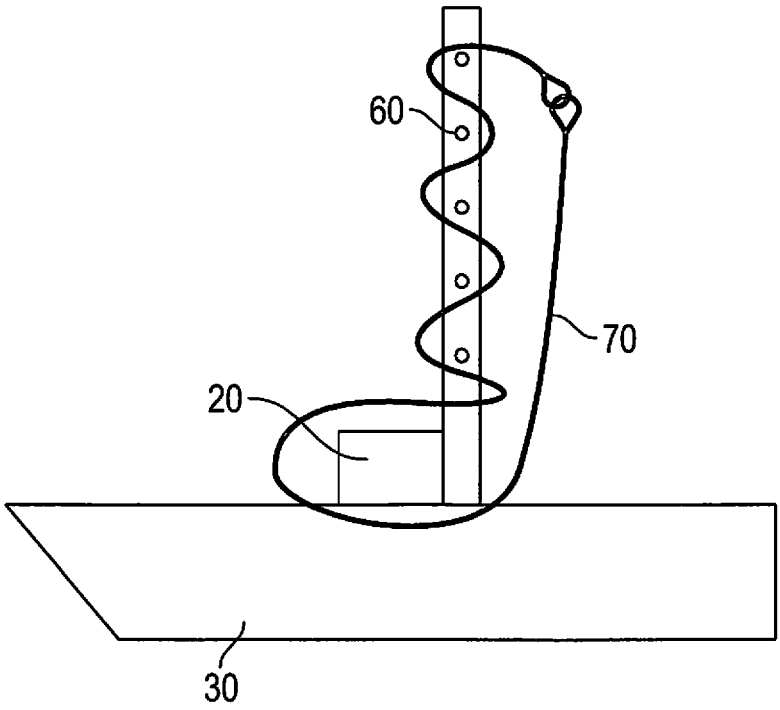
FIG. 14 is a cross section view of a float barrier unit, showing more detail of the lanyard/net segment connection to the spar member.
Figure 15:
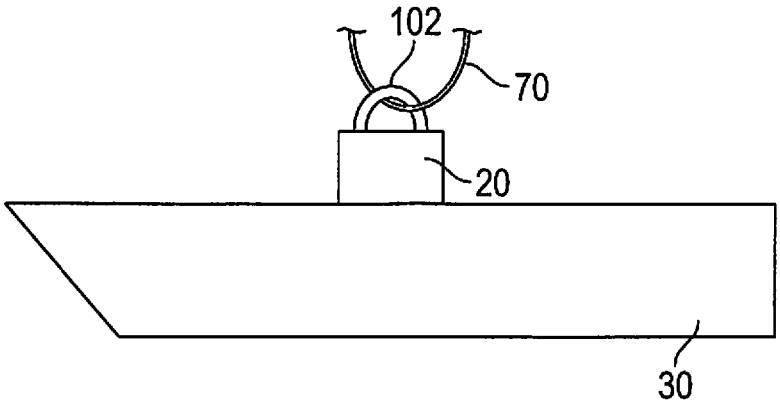
FIG. 15 shows more detail of an alternative attachment of a lanyard to a spar member.

FIG. 14 shows an exemplary embodiment of the attachment of net segment 60 to spar member 20, in more detail. As can be seen, lanyard 70 can be run through the holes (mesh) of set segment 60, and pass round spar member 20, to form the attachment. Alternatively, or in addition, lanyard 70 can run through a connector means 102, for example a ring or the like fixed to spar member 20, see FIG. 15.

One end of buoyant member 30 may comprise a rake 108, as shown in FIG. 10. A rake 108 on the non-threat side of floating barrier unit 10 minimizes or prevents the likelihood of floating barrier unit 10 flipping, due to forces imposed on floating barrier unit 10 by a vessel strike from the threat side.

Figure 11:
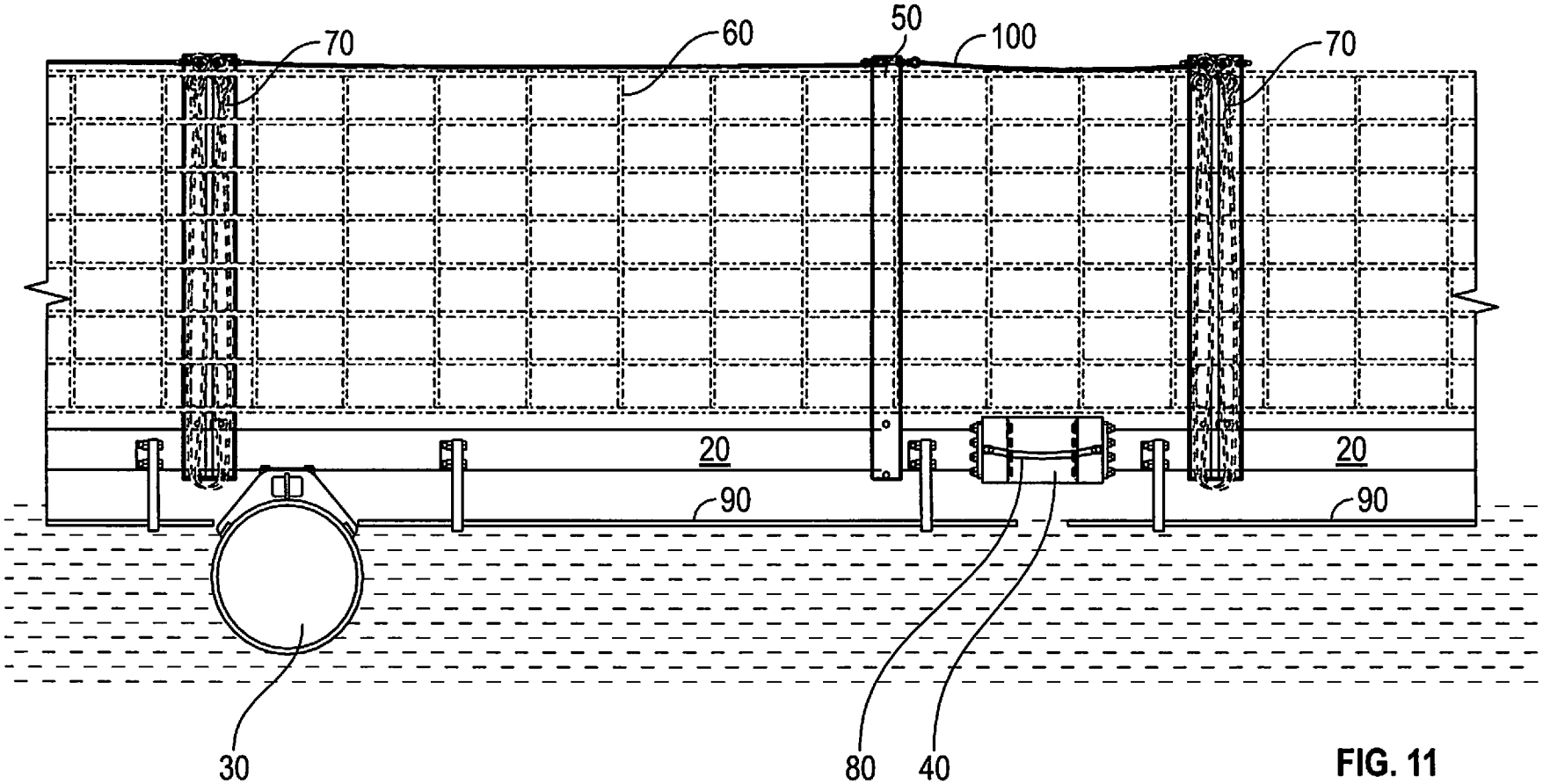
FIG. 11 is a side view of two connected floating barrier units.

FIG. 11 is an additional detailed view of portions of two floating barrier units 10, along with other elements. Barrier element 90, extended downwardly from spar member 20, is shown. Flexible connector member 40, along with secondary flexible connector member 80, are shown.

FIG. 12 is another detailed view of the connection between adjacent floating barrier units 10. Lanyards 70, shown in phantom lines, are shown; note that lanyards 70 for adjacent net segments 60 do not overlap with one another, avoiding disruption of the positioning of one net segment 60 due to a vessel strike on another net segment 60. Flexible connector member 40 is shown. Secondary flexible connector member 80 is also shown, which can take various forms, for example a band or grommet of suitable material.

Figure 16:
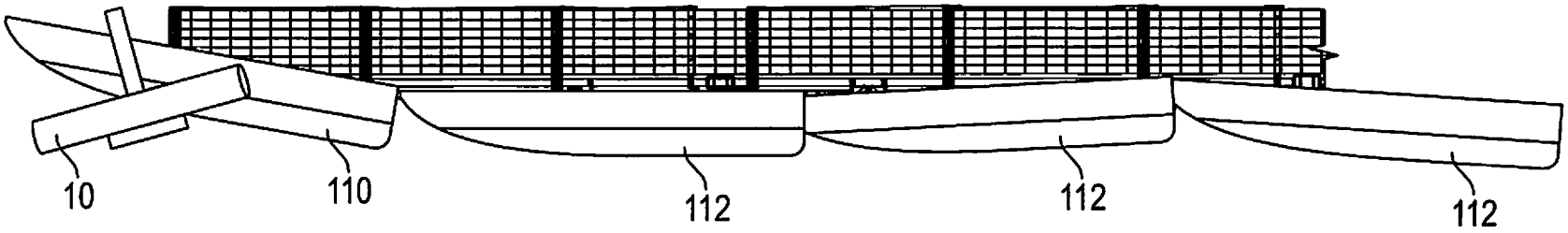
FIG. 16 shows an exemplary vessel strike/multiple vessel attack scenario.

Another aspect of the barrier system is illustrated in FIG. 16. Multiple vessels are attempting to get through barrier system 200; as can be seen, the lead vessel 110 will be stopped by net segment 60, after passing (for example) approximately half the vessel length beyond floating barrier unit 10, effectively lodging in place. Lead vessel 110 itself then serves as an obstacle to following vessels 112. This attribute is a key element in deterring so-called "swarm attacks," from multiple vessels simultaneously.

Materials

Materials for the floating barrier units may be as described above, or other suitable materials known in the relevant art. The spar members and other components may be made of high density polyethylene (HDPE) or other non-corrosive materials, and the vertical support posts may be of tubular metal or a high strength non-metal material. Buoyant float members may also be made of HDPE or other non-corrosive materials, if desired foam-filled. The capture nets/net segments may be of natural or preferably synthetic materials such as nylon or other suitable materials. Lanyards may be of high strength synthetic materials such as nylon, or other suitable materials. It is understood that generally, non-corrosive materials for all components are desired, due to their use in a marine environment.

Manufacture of the various components, and assembly of the components into the floating barrier units and ultimately into the barrier system, may be by processes well known in the relevant art.

Dimensions of the various components may be as needed to suit a particular installation.

CONCLUSION

While the preceding description contains many specificities, it is to be understood that same are presented only to describe some of the presently preferred embodiments of the invention, and not by way of limitation. Changes can be made to various aspects of the invention, without departing from the scope thereof.

Therefore, the scope of the invention is to be determined not by the illustrative examples set forth above, but by the appended claims and their legal equivalents.

We claim:

1. A floating barrier system, comprising a plurality of connected floating barrier units, said floating barrier units comprising:

a horizontal member with a plurality of float members attached thereto;

a plurality of support posts attached to said horizontal member and extending upwardly therefrom;

a capture net connected to said support posts and extending upwardly from said horizontal member;

a plurality of lanyards connecting said capture net to said horizontal member, whereby forces imposed on said capture net by a vessel striking said capture net are transferred to said lanyards and then to said horizontal member; and a connector connected to said horizontal members of adjacent floating barrier units, thereby connecting said adjacent floating barrier units, wherein said float members comprise sufficient buoyancy to float said floating barrier unit on a waterbody, and wherein a capture net on one floating barrier unit extends beyond an end of said horizontal member and connects to a support post on an adjacent floating barrier unit.

2. Apparatus, comprising:

one or more floating barrier units, each barrier unit comprising a spar member supported in relation to a waterbody having a surface by one or more buoyant members, said spar member having a length;

a plurality of support post members attached to said spar member and extending upwardly therefrom;

a net segment having first and second ends and a length, said net segment attached to said plurality of support post members and positioned above said surface of said waterbody; and one or more lanyards attaching said net segment to said spar member, whereby forces transferred to said net segment by a vessel striking said net segment are transferred by said one or more lanyards to said spar member.

3. The apparatus of claim 2, wherein:

said length of said net segment is less than said length of said spar member;

said net segment is supported by a net segment support element which extends between said plurality of support post members; and said one or more lanyards run through openings in said net segment proximal said first and second ends of said net, and said one or more lanyards connect to said spar member.

4. The apparatus of claim 3, wherein said one or more buoyant members comprise two or more spaced-apart buoyant members oriented generally perpendicularly to said spar member and extending from either side of said spar member.

5. The apparatus of claim 4, wherein one end of said buoyant members comprise a raked end.

6. The apparatus of claim 5, wherein said spar member is positioned above said surface of said waterbody, and further comprising a barrier element extending below said spar member toward said waterbody.

7. The apparatus of claim 3, wherein said lanyards connect to said spar member by passing around said spar member.

8. The apparatus of claim 3, wherein said lanyards connect to said spar member by a connector means.

9. A floating barrier system, comprising:

a plurality of connected floating barrier units, each barrier unit comprising a spar member supported in relation to a waterbody by one or more buoyant members, said spar member having a length, said floating barrier units connected by flexible connector members;

a plurality of support post members attached to each of said spar members and extending upwardly therefrom;

a plurality of net segments mounted on each of said floating barrier units, each of said net segments having first and second ends and a length less than a length of said spar member, said net segments attached to said plurality of support post members, said net segments positioned above said surface of said waterbody; and a plurality of lanyards attaching each of said net segments to said spar member, whereby forces transferred to said net by a vessel striking said net are transferred by said one or more lanyards to said spar member.

10. The floating barrier system of claim 9, further comprising a net support element spanning said support post members, and wherein said net segments are suspended from said net support element.

11. The floating barrier system of claim 9, wherein upon a vessel striking one or more of said net segments with sufficient force, one or more of said support post members structurally fail, and said force from said vessel strike is transferred to said plurality of lanyards and to said spar member.

12. The floating barrier system of claim 9, wherein upon a vessel striking one or more of said net segments with sufficient force, said net segment support element fails, and said force from said vessel strike is transferred to said plurality of lanyards and to said spar member.

13. The floating barrier system of claim 9, wherein upon a vessel striking one or more of said net segments with sufficient force, said net segments become detached from said support post members, and said force from said vessel strike is transferred to said plurality of lanyards and to said spar member.

14. The floating barrier system of claim 9, wherein said lanyards are attached to said spar member by passing around said spar member.

15. The floating barrier system of claim 9, wherein said lanyards are attached to said spar member by a connector means.

16. The floating barrier system of claim 9, wherein at least one of said net segments extends beyond an end of said spar member, across said flexible connector member to an adjacent spar member and is connected to a support post member on said adjacent spar member, and wherein said at least one net segment is connected to each of said spar members by lanyards.

17. The floating barrier system of claim 9, wherein said flexible connector member comprises a urethane connector member.

18. The floating barrier system of claim 17, further comprising a secondary flexible connector member connecting said floating barrier sections.

19. The floating barrier system of claim 9, wherein said one or more buoyant members comprise a plurality of elongated buoyant members disposed substantially perpendicular to said spar member and extending outwardly from said spar member.

20. The floating barrier system of claim 19, wherein an end of said elongated buoyant members comprises a raked end.

21. The floating barrier system of claim 9, wherein first and second sides are defined relative to said floating barrier units, and wherein said plurality of support post members are attached in pairs to alternating first and second sides of said floating barrier units, whereby said net segments are attached to said alternating pairs of support post members so that said net segments are positioned on alternating first and second sides of said floating barrier units.

22. The floating barrier system of claim 9, wherein upon a vessel striking one of said net segments with sufficient force, said force is transmitted to said spar member by said net segment and said lanyards, said vessel is at least partially enclosed in said net segment and prevented from passage over said spar member, whereby said vessel forms an obstacle to passage by other vessels.

23. The floating barrier system of claim 9, further comprising barrier elements attached to said spar member and extending downwardly therefrom.

24. Apparatus, comprising:

one or more floating barrier units, each barrier unit comprising a spar member supported in relation to a waterbody having a surface by one or more buoyant members, said spar member having a length;

a plurality of support post members attached to said spar member and extending upwardly therefrom;

a net segment having first and second ends and a length, said net segment attached to said plurality of support post members and positioned above said surface of said waterbody; and one or more lanyards attaching said net segment to said spar member, whereby forces transferred to said net segment by a vessel striking said net segment are transferred by said one or more lanyards to said spar member;

wherein:

said length of said net segment is less than said length of said spar member;

said net segment is supported by a net segment support element which extends between said plurality of support post members; and said one or more lanyards run through openings in said net segment proximal said first and second ends of said net, and said one or more lanyards connect to said spar member by passing around said spar member.

25. A floating barrier system, comprising:

a plurality of connected floating barrier units, each barrier unit comprising a spar member supported in relation to a waterbody by one or more buoyant members, said spar member having a length, said floating barrier units connected by flexible connector members;

a plurality of support post members attached to each of said spar members and extending upwardly therefrom;

a plurality of net segments mounted on each of said floating barrier units, each of said net segments having first and second ends and a length less than a length of said spar member, said net segments attached to said plurality of support post members, said net segments positioned above said surface of said waterbody; and a plurality of lanyards attaching each of said net segments to said spar member, whereby forces transferred to said net by a vessel striking said net are transferred by said one or more lanyards to said spar member, wherein said lanyards are attached to said spar member by passing around said spar member.

* * * * *